US010177441B2

(12) United States Patent
Mai et al.

(10) Patent No.: US 10,177,441 B2
(45) Date of Patent: Jan. 8, 2019

(54) ANTENNA MODULE

(71) Applicant: ASUSTeK COMPUTER INC., Taipei (TW)

(72) Inventors: Yu-Shen Mai, Taipei (TW); Zhao-Wei Han, Taipei (TW); Han-Wei Li, Taipei (TW)

(73) Assignee: ASUSTeK COMPUTER INC., Taipei (TW)

( * ) Notice: Subject to any disclaimer, the term of this patent is extended or adjusted under 35 U.S.C. 154(b) by 6 days.

(21) Appl. No.: 15/291,082

(22) Filed: Oct. 12, 2016

(65) Prior Publication Data

US 2017/0110788 A1 Apr. 20, 2017

Related U.S. Application Data

(60) Provisional application No. 62/242,262, filed on Oct. 15, 2015.

(30) Foreign Application Priority Data

Apr. 12, 2016 (TW) ..... 105111313 A

(51) Int. Cl.

| | |
|---|---|
| ***H01Q 1/24*** | (2006.01) |
| ***H01Q 1/02*** | (2006.01) |
| ***H01Q 1/52*** | (2006.01) |
| *H01Q 1/22* | (2006.01) |

(52) U.S. Cl.

CPC ..... *H01Q 1/243* (2013.01); *H01Q 1/02* (2013.01); *H01Q 1/521* (2013.01); *H01Q 1/2266* (2013.01)

(58) Field of Classification Search

None

See application file for complete search history.

(56) References Cited

U.S. PATENT DOCUMENTS

| | | | | |
|---|---|---|---|---|
| 7,348,932 | B1 * | 3/2008 | Puzella | H01Q 21/0025 342/373 |
| 9,805,861 | B2 * | 10/2017 | Kato | H01F 27/36 |
| 9,877,412 | B2 * | 1/2018 | Seo | H05K 7/2039 |
| 9,991,245 | B2 * | 6/2018 | Kim | H01L 25/50 |
| 2004/0238944 | A1 * | 12/2004 | Bish | H01L 23/10 257/706 |
| 2010/0079344 | A1 * | 4/2010 | Rahm | H01Q 1/44 343/702 |
| 2014/0085149 | A1 * | 3/2014 | Cho | H01Q 1/22 343/702 |

(Continued)

FOREIGN PATENT DOCUMENTS

| | | |
|---|---|---|
| CN | 102025025 | 4/2011 |
| CN | 103872455 | 6/2014 |

*Primary Examiner* — Trinh Dinh

(74) *Attorney, Agent, or Firm* — JCIPRNET

(57) ABSTRACT

An antenna module suited for a portable electronic device is provided. The antenna module includes a heat dissipation unit, a first antenna and a second antenna. The heat dissipation unit contacts a heat source of the portable electronic device. The first antenna and the second antenna are disposed at different side portions of the heat dissipation unit. The heat dissipation unit has a slot with at least one bending portion. An orthogonal projection of at least one of the first antenna and the second antenna on a projection plane of the heat dissipation unit is partly overlapped with an orthogonal projection of the slot on the projection plane.

18 Claims, 4 Drawing Sheets

(56) References Cited

U.S. PATENT DOCUMENTS

2016/0255184 A1* 9/2016 Hwang ..... H04B 5/0031
455/41.1
2018/0132376 A1* 5/2018 Shin ..... H05K 7/20

* cited by examiner

ANTENNA MODULE

CROSS-REFERENCE TO RELATED APPLICATION

This application claims the priority benefit of U.S. provisional application Ser. No. 62/242,262, filed on Oct. 15, 2015 and Taiwan application serial No. 105111313, filed on Apr. 12, 2016. The entirety of each of the above-mentioned patent applications is hereby incorporated by references herein and made a part of specification.

BACKGROUND OF THE INVENTION

Field of the Invention

The invention relates to an antenna module and, more specifically, to an antenna module of a portable electronic device.

Description of the Related Art

Multiple antenna systems, such as a Pattern Switchable or Beam Steering Antenna system and a Multi-input Multi-output Antenna (MIMO) system, are developed for the demand for better signal quality, and higher reliability and the transmission speed of wireless signals. For example, the MIMO technology is already applied in products successfully, such as in a notebook, a handheld communication device and a wireless access point.

To solve the problem of multiple-path fading of the antenna, the MIMO antenna system is widely used. However, the wireless electronic devices on the market are designed lighter, smaller, and thinner, which results less space for placing antennas and the isolation between antennas is thus reduced. As a result, the fundamental frequency signal is not easily processed, the transmission speed is slow, and the interference between the antennas makes the gain decreased.

BRIEF SUMMARY OF THE INVENTION

According to one aspect of the disclosure, an antenna module for a portable electronic device, comprises; a heat dissipation unit contacted with at least one heat source of the portable electronic device; a first antenna disposed at a side portion of the heat dissipation unit; and a second antenna disposed at another side portion of the heat dissipation unit, wherein the heat dissipation unit includes at least one slot, the slot includes at least one bending portion, and an orthogonal projection of the at least one of the first antenna and the second antenna on a projection plane of the heat dissipation unit is partly overlapped with an orthogonal projection of the slot on the projection plane.

In sum, by disposing the first antenna and the second antenna of the antenna module on the heat dissipation unit, the antennas are disposed away from the circuit board inside the portable electronic device. In the meantime, the heat dissipation unit includes a slot with at least one bending portion, and makes an orthogonal projection of at least one of the first antenna and the second antenna be partly overlapped with an orthogonal projection of the slot, the electromagnetic shielding is formed between the two antennas to improve the isolation there between.

BRIEF DESCRIPTION OF THE DRAWINGS

These and other features, aspects and advantages of the invention will become better understood with regard to the following embodiments and accompanying drawings.

DETAILED DESCRIPTION OF THE EMBODIMENTS

Figure 1:
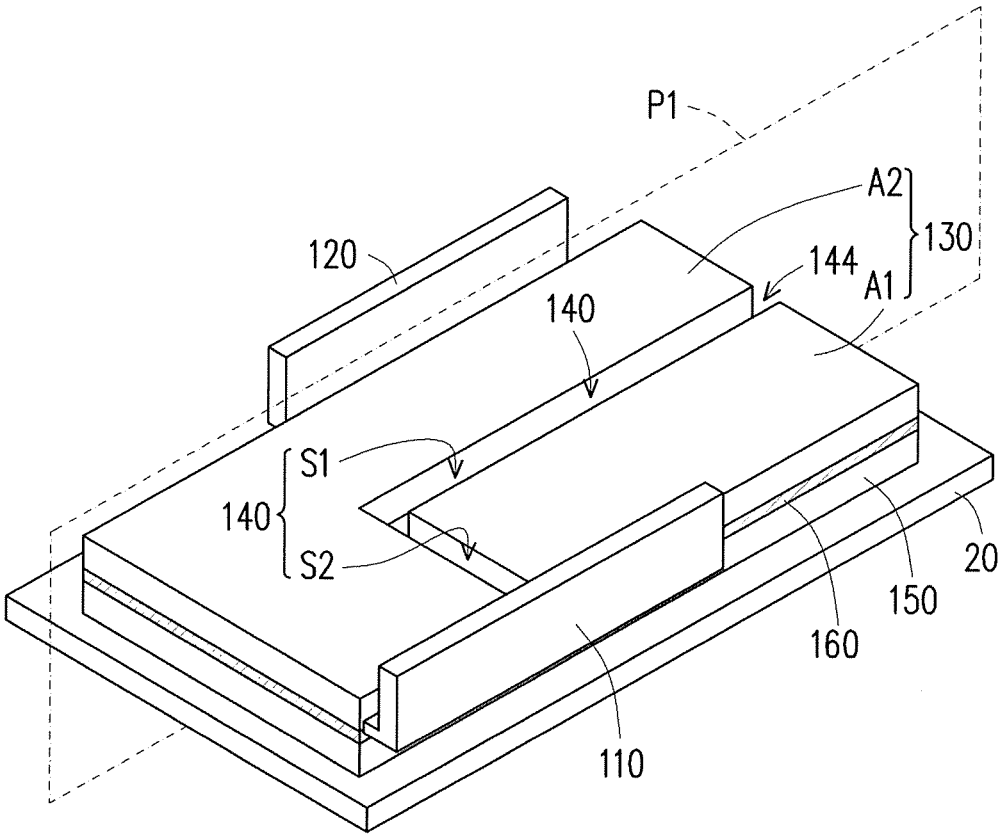
FIG. 1 is a schematic diagram of an antenna module according to an embodiment.
Figure 2:
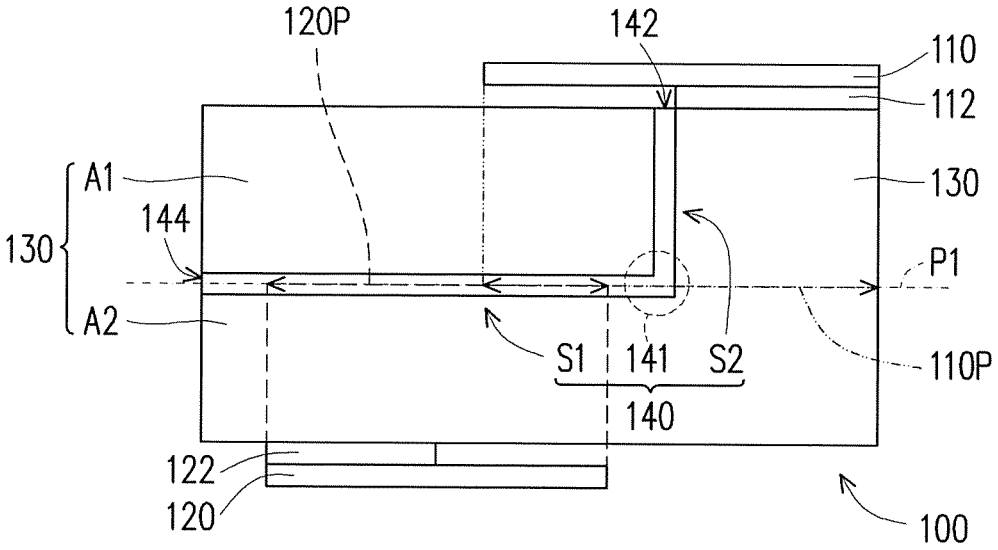
FIG. 2 is a top view of an antenna module in FIG. 1.

FIG. 1 is a schematic diagram of an antenna module according to an embodiment of which the antenna module locates inside the portable electronic device. FIG. 2 is a top view of the antenna module in FIG. 1. Please refer to FIG. 1 and FIG. 2, in an embodiment, the antenna module 100 is adapted for at least a heat source 20 of the portable electronic device. The antenna module 100 includes a first antenna 110, a second antenna 120 and a heat dissipation unit 130. In the embodiment, the heat source 20 of the portable electronic device is a processor (or a display chip) disposed in a notebook computer, which is not limited herein. The heat dissipation unit 130 is a foil or a heat sink, the heat dissipation unit 130 contacts the heat source 20 to dissipate the heat from the heat source 20.

The first antenna 110 and the second antenna 120 are Multi-input Multi-output (MIMO) antennas with a same frequency band. In an embodiment, the first antenna 110 and the second antenna 120 are MIMO antennas with an Industrial Scientific Medical (ISM) frequency band. As shown in FIG. 2, the first antenna 110 is connected with a side portion of the heat dissipation unit 130 via a connecting portion 112. The second antenna 120 is connected with the other side portion of the heat dissipation unit 130 via a connecting portion 122. Due to the conductivity of the heat dissipation unit 130, the first antenna 110 and the second antenna 120 is grounded. In the embodiment, the connecting portion 112, 122 are foils or elastic sheets with conductivity, which is not limited herein.

In an embodiment, the antenna module 100 further includes a component 150. The heat dissipation unit 130 is disposed on the component 150 to thermally contact with the heat source 20. In the embodiment, the component 150 is another heat dissipation unit (such as a foil or a heat sink structure). A gap 160 is formed between the heat dissipation unit 130 and the component 150. In an embodiment, the gap 160 is filled with a conductive material (such as conductive adhesive or conductive foam).

Figure 3:
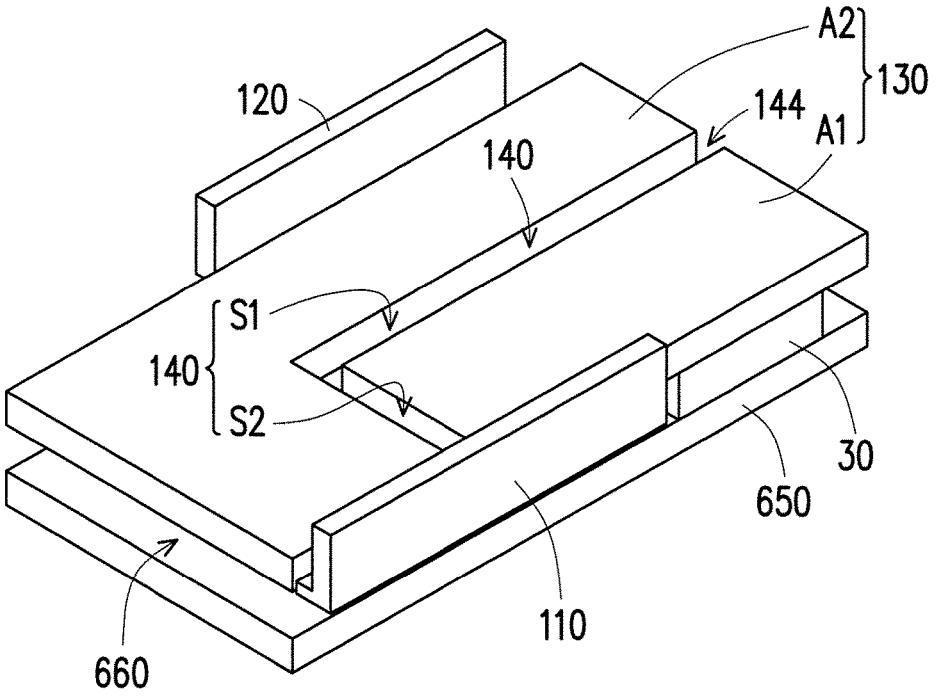
FIG. 3 is a schematic diagram of an antenna module according to an embodiment.

FIG. 3 is a schematic diagram of an antenna module according to an embodiment. In the embodiment, the component 650 is a printed circuit board (PCB) (such as a motherboard inside a notebook computer). The heat dissipation unit 130 directly contacts a processor or a display chip (that is, the heat source 30) disposed on the printed circuit board. An air gap 660 is kept between the heat dissipation unit 130 and the component 650. Since the antenna is not disposed on the motherboard, the space for other electronic elements on the motherboard is improved.

Please refer to FIG. 1 and FIG. 2, the heat dissipation unit 130 includes at least one slot 140, and the slot 140 includes at least one bending portion 141. An orthogonal projection of at least one of the first antenna 110 and the second antenna 120 on a projection plane P1 of the heat dissipation unit 130 is partly overlapped with an orthogonal projection of the slot 140 on the projection plane P1. As shown in FIG. 2, an orthogonal projection 120P of the second antenna 120 on the projection plane P1 is completely overlapped with a first section S1 of the slot 140. In an embodiment, an orthogonal projection 110P of the first antenna 110 on the projection plane P1 is partly overlapped with the first section S1 of the slot 140. The projection plane P1 is a normal plane of the primary surface of the heat dissipation unit 130, and a first section S1 of the slot 140 is projected to the projection plane P1. Consequently, by forming the slots 140 on the heat dissipation unit 130, the isolation between the first antenna 110 and the second antenna 120 is improved effectively. In an embodiment, an orthogonal projection of at least one of the first antenna 110 and the second antenna 120 is overlapped with an orthogonal projection of a second section S2.

In an embodiment, a distance between the first antenna 110 and the second antenna 120 is less than 1λ, and the λ, is a wave length of the resonance frequency band (such as 2.4 GHz) of the first antenna 110 and the second antenna 120. Due to the slot 140, an electromagnetic wave generated between the first antenna 110 and the second antenna 120 generates sufficient disturbance via the electromagnetic effects to improve the isolation and communication quality between the antennas, and the length of the slot 140 (the sum of the first section S1 and the second section S2) is 0.2λ to 0.4λ. In other words, since a capacitive load can be formed by the slot 140, an electric fields disturbance generated by the slot 140 can be shared for the first antenna 110 and the second antenna 120 to reduce the resonant length between the first antenna 110 and the second antenna 120. That is, the occupied volume (space) of the first antenna 110 and the second antenna 120 is reduced. The portable electronic device of the embodiment can be designed smaller, thinner and shorter.

Figure 4:
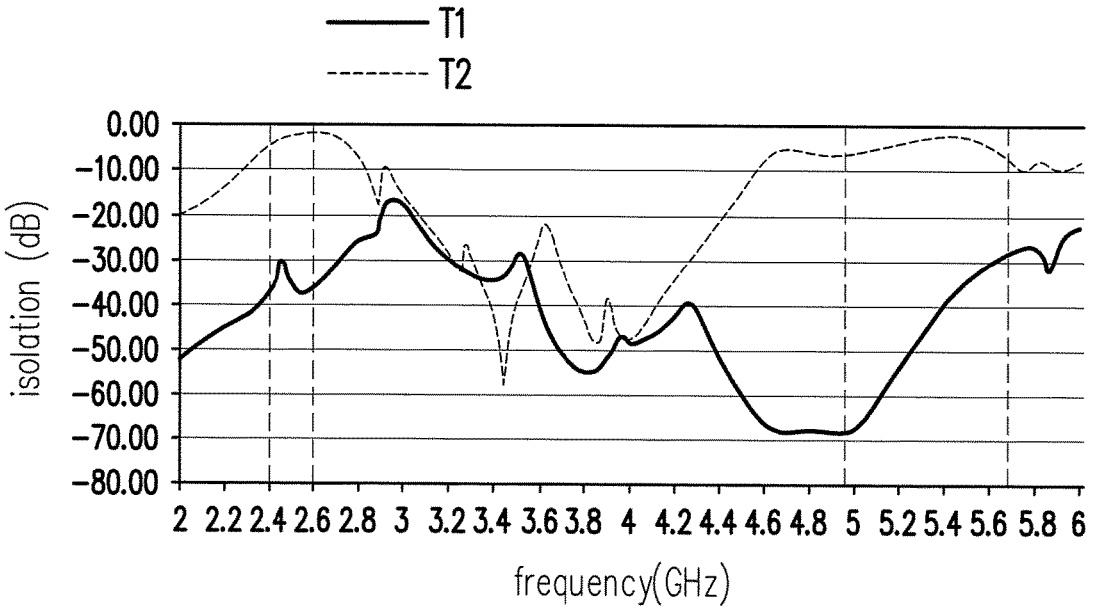
FIG. 4 is a diagram showing the isolation of the antenna module in an embodiment in comparison with the isolation of a conventional antenna module.

FIG. 4 is a diagram comparing the isolation of an antenna module in an embodiment to the isolation of a conventional antenna module. The curve T1 corresponds to the antenna module in the embodiment, and the curve T2 corresponds to the conventional antenna module. Please refer to FIG. 3, as the configuration mentioned above, by disposing the antenna module 100 on the heat dissipation unit 130 and taking the above slot 140 as an electromagnetic wave isolation component, the isolation between the first antenna 110 and the second antenna 120 is less than −15 dB or −20 dB. In an embodiment, the isolation is optimal at the required frequency band, such as at 2.4 GHz to 2.6 GHz or 5 GHz to 5.6 GHz. In an embodiment, taking the MIMO antenna for example, the isolation can be kept less than −30 dB between each two antennas.

The configuration between the heat dissipation unit and the first antenna and the second antenna in another embodiment is described hereinafter, while the same effect of the isolation is also achieved.

Figure 5:
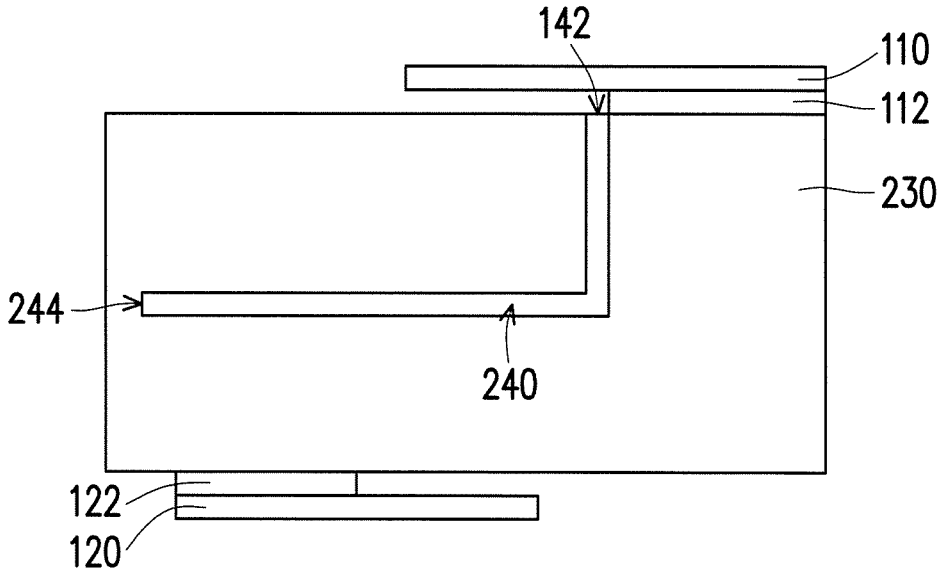
FIG. 5 is a top view of an antenna module according to an embodiment.
Figure 6:
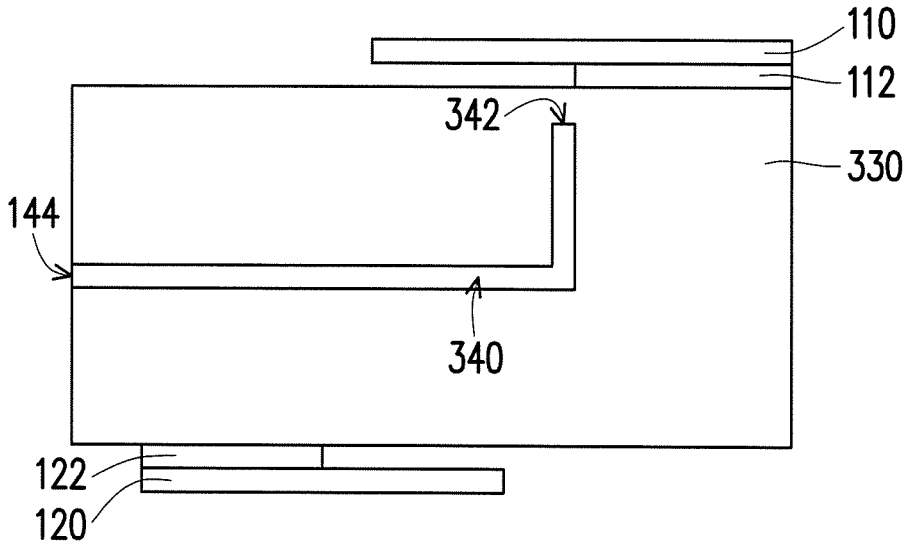
FIG. 6 is a top view of an antenna module according to an embodiment.

FIG. 5 and FIG. 6 are top views of antenna modules according to an embodiment. Please refer to FIG. 5 and FIG. 6, comparing to FIG. 2, the opposite two ends (a first end 142, a second end 144) of the slot 140 in FIG. 2 are opened. The opened position of the first end 142 is located at the connecting zone between the connecting portion 112 of the first antenna 110 and the heat dissipation unit 130. That is, the slot 140 and the first antenna 110 intersect at the first end 142. The second end 144 of the slot 140 is located on the heat dissipation unit 130 backed to the first antenna 110 and the second antenna 120. In FIG. 5, the second end 244 of the slot 240 in the heat dissipation unit 230 is closed. In FIG. 6, the first end 342 of the slot 340 in the heat dissipation unit 330 is closed.

Figure 7:
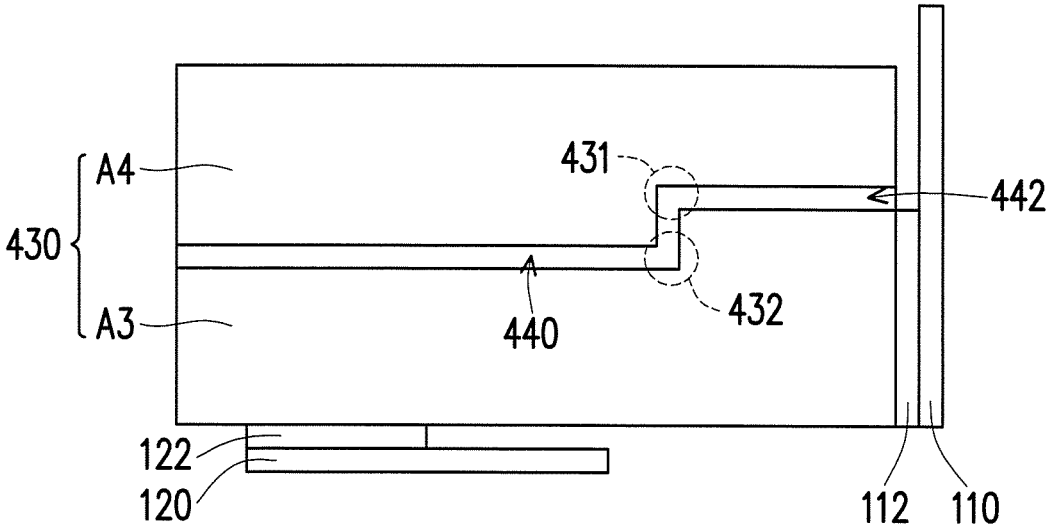
FIG. 7 is a top view of an antenna module according to an embodiment.

FIG. 7 is a top view of an antenna module according to an embodiment. Please refer to FIG. 7 and comparing to FIG. 2. In the embodiment of FIG. 7, the first antenna 110 and the second antenna 120 are located on the adjacent side portions of the heat dissipation unit 130. The slot 140 at the heat dissipation unit 430 includes two bending portions 431, 432. In the configuration, the isolation between the antennas is improved, and the mutual interference of the electromagnetic wave is reduced when the antennas are moved closed to each other.

Figure 8:
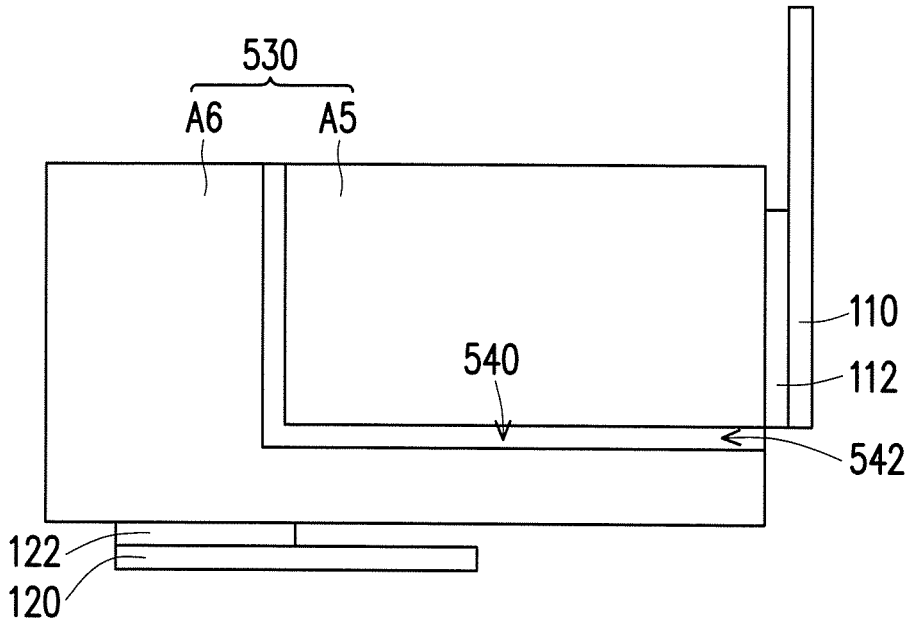
FIG. 8 is a top view of an antenna module according to an embodiment.

FIG. 8 is a top view of an antenna module according to an embodiment. Please refer to FIG. 8 and comparing to FIG. 2 and FIG. 7. In the embodiment of FIG. 2, the heat dissipation unit 130 is separated into different areas A1, A2 via the slot. The first antenna 110 and the second antenna 120 are connected with the same area A2 of the heat dissipation unit 130. Similarly, in an embodiment of FIG. 7, the heat dissipation unit 130 is separated into different areas A3, A4 via the slot 440. The first antenna 110 and the second antenna 120 are connected with the same area A3. Please refer to FIG. 8, the heat dissipation unit 530 is separated into different areas A5, A6 via the slot 540. The first antenna 110 is configured at the area A5. The second antenna 120 is configured at the area A6. Furthermore, in the embodiment in FIG. 8, the first end 542 and the second end 544 of the slot are opened, and the opening of the first end 542 is considered as the intersection between the first end 542 and the first antenna 110.

In sum, in embodiments, by connecting the first antenna and the second antenna of the MIMO antenna with the heat dissipation unit, instead of disposing the antennas on the circuit board of the portable electronic device, the space on the circuit board for other electronic components is improved. Furthermore, the heat dissipation unit is conductive, and the heat dissipation unit is grounded. Additionally, since the slot is formed on the heat dissipation unit, electromagnetic shielding effect is generated between the antennas, and then the isolation between the antennas is improved. The slot, the first antenna and the second antenna has different configurations according to requirements to make the antenna module has good isolation at the ISM frequency band.

Although the invention has been disclosed with reference to certain embodiments thereof, the disclosure is not for limiting the scope. Persons having ordinary skill in the art may make various modifications and changes without departing from the scope of the invention. Therefore, the scope of the appended claims should not be limited to the description of the embodiments described above.

What is claimed is:

1. An antenna module for a portable electronic device, comprising;

a heat dissipation unit;

a first antenna disposed at a side portion of the heat dissipation unit; and a second antenna disposed at another side portion of the heat dissipation unit;

wherein the heat dissipation unit includes at least one slot, the slot includes at least one bending portion to generate an electromagnetic shielding effect and an isolation between the first antenna and the second antenna, and an orthogonal projection of the first antenna or the second antenna on a projection plane of the heat dissipation unit is partly overlapped with an orthogonal projection of the slot on the projection plane, wherein a distance between the first antenna and the second antenna is less than 1λ or a length of the slot is 0.2λ to 0.4λ, and the λ is a wave length of a resonance frequency band of the first antenna and the second antenna.

2. The antenna module according to claim 1, wherein the heat dissipation unit is conductive.

3. The antenna module according to claim 1, wherein the first antenna and the second antenna are located at opposite side portions or adjacent side portions of the heat dissipation unit.

4. The antenna module according to claim 1, wherein the heat dissipation unit is separated into two areas via the slot, the first antenna and the second antenna are connected with the same area or the two different areas, respectively.

5. The antenna module according to claim 1, wherein the first antenna and the second antenna are a Multi-input Multi-output antenna with Industrial Scientific Medical frequency band.

6. The antenna module according to claim 1, wherein at least one of two ends of the slot is closed or opened.

7. The antenna module according to claim 1, further comprising:

a component, wherein the heat dissipation unit is located above the component and keep a gap therebetween.

8. The antenna module according to claim 7, wherein the component is another heat dissipation unit or a circuit board.

9. The antenna module according to claim 7, wherein the gap is filled with a conducting medium.

10. An antenna module for a portable electronic device, comprising:

a heat dissipation unit;

a first antenna disposed at a side portion of the heat dissipation unit; and a second antenna disposed at another side portion of the heat dissipation unit;

wherein the heat dissipation unit includes at least one slot, the slot includes at least one bending portion, and an orthogonal projection of the first antenna or the second antenna on a projection plane of the heat dissipation unit is partly overlapped with an orthogonal projection of the slot on the projection plane, wherein the slot extends from one end of the heat dissipation unit to another end of the heat dissipation unit and separates the heat dissipation unit into two independent areas, the first antenna and the second antenna are connected with the same area or the two different areas, respectively.

11. The antenna module according to claim 10, wherein the heat dissipation unit is conductive.

12. The antenna module according to claim 10, wherein a distance between the first antenna and the second antenna is less than 1λ, and the λ is a wave length of a resonance frequency band of the first antenna and the second antenna.

13. The antenna module according to claim 10, wherein a length of the slot is 0.2λ to 0.4λ, and the λ is a wave length of a resonance frequency band of the first antenna and the second antenna.

14. The antenna module according to claim 10, wherein the first antenna and the second antenna are located at opposite side portions or adjacent side portions of the heat dissipation unit.

15. The antenna module according to claim 10, wherein the first antenna and the second antenna are a Multi-input Multi-output antenna with Industrial Scientific Medical frequency band.

16. The antenna module according to claim 10, further comprising:

a component, wherein the heat dissipation unit is located above the component and keep a gap therebetween.

17. The antenna module according to claim 16, wherein the component is another heat dissipation unit or a circuit board.

18. The antenna module according to claim 16, wherein the gap is filled with a conducting medium.

* * * * *